US010359731B2

(12) United States Patent
Sakato et al.

(10) Patent No.: US 10,359,731 B2
(45) Date of Patent: Jul. 23, 2019

(54) IMAGE FORMING APPARATUS THAT RESTRAINS TURNING-UP OF THE CLEANING BLADE

(71) Applicant: KYOCERA Document Solutions Inc., Osaka (JP)

(72) Inventors: Shingo Sakato, Osaka (JP); Katsuya Ota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/995,470

(22) Filed: Jun. 1, 2018

(65) Prior Publication Data

US 2018/0364635 A1 Dec. 20, 2018

(30) Foreign Application Priority Data

Jun. 15, 2017 (JP) ..... 2017-118075

(51) Int. Cl.
*G03G 21/10* (2006.01)
*G03G 21/00* (2006.01)

(52) U.S. Cl.
CPC ..... *G03G 21/10* (2013.01); *G03G 21/0011* (2013.01); *G03G 21/0094* (2013.01)

(58) Field of Classification Search
None
See application file for complete search history.

(56) References Cited

U.S. PATENT DOCUMENTS

2013/0051832 A1* 2/2013 Aiba ..... G03G 15/0189 399/71
2014/0340457 A1* 11/2014 Hashimoto ..... G03G 21/0011 347/118

FOREIGN PATENT DOCUMENTS

JP 2014-142470 A 8/2014

* cited by examiner

*Primary Examiner* — Victor Verbitsky
(74) *Attorney, Agent, or Firm* — Studebaker & Brackett PC

(57) ABSTRACT

An image forming apparatus includes an image carrier carrying a toner image, a developing device, and a cleaning blade. The developing device carries out developing process feeding toner to the image carrier during image forming. The cleaning blade comes into contact with the image carrier and removes waste toner remained on the image carrier. In order to restrain turning-up of the cleaning blade, turning-up restraining process is carried out to feed the toner from the developing device to the image carrier during non-image forming, every time a given cumulative printing number of image forming operation is finished. In the turning-up restraining process, larger toner is fed to the image carrier as a given small size printing number in the cumulative printing number becomes larger.

5 Claims, 6 Drawing Sheets

FIG. 3

MULTIPLYING FACTOR PDR BEFORE RECALCULATING VARIABLE k
(an integer: remainder is cut off)

| AVERAGE PRINTING RATE RIA (%) | RATIO (PA2/PA1) OF THE SMALL SIZE PRINTING NUMBER (%) | | | | | | | | | | |
|---|---|---|---|---|---|---|---|---|---|---|---|
| | 0 | 10 | 20 | 30 | 40 | 50 | 60 | 70 | 80 | 90 | 100 |
| 1.0 | 1 | 1 | 2 | 3 | 4 | 5 | 6 | 7 | 8 | 9 | 10 |
| 1.2 | 1 | 1 | 2 | 3 | 4 | 5 | 6 | 7 | 8 | 9 | 10 |
| 1.4 | 1 | 1 | 2 | 3 | 4 | 5 | 6 | 7 | 8 | 9 | 10 |
| 1.6 | 1 | 1 | 2 | 3 | 4 | 5 | 6 | 7 | 8 | 9 | 10 |
| 1.8 | 1 | 1 | 2 | 3 | 4 | 5 | 6 | 7 | 8 | 9 | 10 |
| 2.0 | 1 | 1 | 2 | 3 | 4 | 5 | 6 | 7 | 8 | 9 | 10 |
| 2.5 | 1 | 1 | 2 | 3 | 4 | 5 | 6 | 7 | 8 | 9 | 10 |
| 3.0 | 1 | 1 | 2 | 3 | 4 | 5 | 6 | 7 | 8 | 9 | 10 |
| 4.0 | 1 | 1 | 2 | 3 | 4 | 5 | 6 | 7 | 8 | 9 | 10 |
| 5.0 | 1 | 1 | 2 | 3 | 4 | 5 | 6 | 7 | 8 | 9 | 10 |

FIG. 4

TOTAL COLLECTING AMOUNT C2 (g) BEFORE RECALCULATING VARIABLE k

| AVERAGE PRINTING RATE RIA (%) | RATIO (PA2/PA1) OF THE SMALL SIZE PRINTING NUMBER (%) | | | | | | | | | | |
|---|---|---|---|---|---|---|---|---|---|---|---|
| | 0 | 10 | 20 | 30 | 40 | 50 | 60 | 70 | 80 | 90 | 100 |
| 1.0 | 59.1 | 59.1 | 70.8 | 82.1 | 93.0 | 103.5 | 113.6 | 123.4 | 132.8 | 141.9 | 150.7 |
| 1.2 | 57.1 | 57.1 | 67.0 | 76.5 | 85.8 | 94.8 | 103.5 | 111.9 | 120.2 | 128.1 | 135.9 |
| 1.4 | 55.7 | 55.7 | 64.2 | 72.5 | 80.5 | 88.4 | 96.0 | 103.5 | 110.8 | 117.8 | 124.7 |
| 1.6 | 54.6 | 54.6 | 62.1 | 69.4 | 76.5 | 83.5 | 90.3 | 97.0 | 103.5 | 109.9 | 116.1 |
| 1.8 | 53.7 | 53.7 | 60.4 | 67.0 | 73.4 | 79.7 | 85.8 | 91.8 | 97.7 | 103.5 | 109.2 |
| 2.0 | 53.0 | 53.0 | 59.1 | 65.0 | 70.8 | 76.5 | 82.1 | 87.6 | 93.0 | 98.3 | 103.5 |
| 2.5 | 51.8 | 51.8 | 56.7 | 61.5 | 66.2 | 70.8 | 75.4 | 79.9 | 84.3 | 88.7 | 93.0 |
| 3.0 | 51.0 | 51.0 | 55.1 | 59.1 | 63.1 | 67.0 | 70.8 | 74.6 | 78.4 | 82.1 | 85.8 |
| 4.0 | 50.0 | 50.0 | 53.0 | 56.1 | 59.1 | 62.1 | 65.0 | 67.9 | 70.8 | 73.7 | 76.5 |
| 5.0 | 49.4 | 49.4 | 51.8 | 54.3 | 56.7 | 59.1 | 61.5 | 63.8 | 66.2 | 68.5 | 70.8 |

FIG. 5

MULTIPLYING FACTOR PDR AFTER RECALCULATING VARIABLE k
(an integer: remainder is cut off)

| AVERAGE PRINTING RATE RIA (%) | RATIO (PA2/PA1) OF THE SMALL SIZE PRINTING NUMBER (%) | | | | | | | | | | |
|---|---|---|---|---|---|---|---|---|---|---|---|
| | 0 | 10 | 20 | 30 | 40 | 50 | 60 | 70 | 80 | 90 | 100 |
| 1.0 | 1 | 1 | 2 | 3 | 4 | 5 | 5 | 5 | 5 | 5 | 5 |
| 1.2 | 1 | 1 | 2 | 3 | 4 | 5 | 6 | 6 | 6 | 6 | 6 |
| 1.4 | 1 | 1 | 2 | 3 | 4 | 5 | 6 | 7 | 7 | 7 | 7 |
| 1.6 | 1 | 1 | 2 | 3 | 4 | 5 | 6 | 7 | 8 | 8 | 8 |
| 1.8 | 1 | 1 | 2 | 3 | 4 | 5 | 6 | 7 | 8 | 9 | 9 |
| 2.0 | 1 | 1 | 2 | 3 | 4 | 5 | 6 | 7 | 8 | 9 | 10 |
| 2.5 | 1 | 1 | 2 | 3 | 4 | 5 | 6 | 7 | 8 | 9 | 10 |
| 3.0 | 1 | 1 | 2 | 3 | 4 | 5 | 6 | 7 | 8 | 9 | 10 |
| 4.0 | 1 | 1 | 2 | 3 | 4 | 5 | 6 | 7 | 8 | 9 | 10 |
| 5.0 | 1 | 1 | 2 | 3 | 4 | 5 | 6 | 7 | 8 | 9 | 10 |

FIG. 6

TOTAL COLLECTING AMOUNT C2 (g) AFTER RECALCULATING VARIABLE k

| AVERAGE PRINTING RATE RIA (%) | RATIO (PA2/PA1) OF THE SMALL SIZE PRINTING NUMBER (%) | | | | | | | | | | |
|---|---|---|---|---|---|---|---|---|---|---|---|
| | 0 | 10 | 20 | 30 | 40 | 50 | 60 | 70 | 80 | 90 | 100 |
| 1.0 | 59.1 | 59.1 | 70.8 | 82.1 | 93.0 | 103.5 | 103.5 | 103.5 | 103.5 | 103.5 | 103.5 |
| 1.2 | 57.1 | 57.1 | 67.0 | 76.5 | 85.8 | 94.8 | 103.5 | 103.5 | 103.5 | 103.5 | 103.5 |
| 1.4 | 55.7 | 55.7 | 64.2 | 72.5 | 80.5 | 88.4 | 96.0 | 103.5 | 103.5 | 103.5 | 103.5 |
| 1.6 | 54.6 | 54.6 | 62.1 | 69.4 | 76.5 | 83.5 | 90.3 | 97.0 | 103.5 | 103.5 | 103.5 |
| 1.8 | 53.7 | 53.7 | 60.4 | 67.0 | 73.4 | 79.7 | 85.8 | 91.8 | 97.7 | 103.5 | 103.5 |
| 2.0 | 53.0 | 53.0 | 59.1 | 65.0 | 70.8 | 76.5 | 82.1 | 87.6 | 93.0 | 98.3 | 103.5 |
| 2.5 | 51.8 | 51.8 | 56.7 | 61.5 | 66.2 | 70.8 | 75.4 | 79.9 | 84.3 | 88.7 | 93.0 |
| 3.0 | 51.0 | 51.0 | 55.1 | 59.1 | 63.1 | 67.0 | 70.8 | 74.6 | 78.4 | 82.1 | 85.8 |
| 4.0 | 50.0 | 50.0 | 53.0 | 56.1 | 59.1 | 62.1 | 65.0 | 67.9 | 70.8 | 73.7 | 76.5 |
| 5.0 | 49.4 | 49.4 | 51.8 | 54.3 | 56.7 | 59.1 | 61.5 | 63.8 | 66.2 | 68.5 | 70.8 |

IMAGE FORMING APPARATUS THAT RESTRAINS TURNING-UP OF THE CLEANING BLADE

INCORPORATION BY REFERENCE

This application is based on and claims the benefit of priority from Japanese Patent application No. 2017-118075 filed on Jun. 15, 2017, the entire contents of which are incorporated herein by reference.

BACKGROUND

The present disclosure relates to an image forming apparatus including a cleaning blade removing waste toner remained on an image carrier carrying a toner image.

Conventionally, an image forming apparatus of an electrographic manner, such as a printer or a copying machine, includes an image carrier, such as a photosensitive drum, having a surface carrying a toner image. In addition, the image forming apparatus includes a developing device developing the toner image onto the image carrier and a transferring device transferring the toner image on the image carrier onto a recording medium, such as a sheet. Further, the image forming apparatus includes a cleaning device removing waste toner remained on the image carrier after transferring and a waste toner box collecting removed waste toner. The cleaning device includes a cleaning blade removing waste toner from the surface of the image carrier.

The cleaning blade is arranged so that its blade edge comes into contact with the surface of the image carrier in a counter direction to a rotating direction of the image carrier. When the image carrier is rotated, by lubricity of an eternal additive of the waste toner on the image carrier, a stick-slip phenomenon of the cleaning blade to the image carrier is restrained. Therefore, if the eternal additive is exhausted, frictional force between the cleaning blade and the surface of the image carrier is increased, balance of the stick-slip phenomenon is lost, and blade turning-up may be caused so that the cleaning blade is turned up in an opposite direction to the counter direction. It is feared that image failure is caused due to the blade turning-up. In order to restrain the blade turning-up, in the image forming apparatus, toner placing (turning-up restraining process) may be carried out so as to feed toner from the developing device to the image carrier.

As an example, the image forming apparatus includes a photosensitive body (photoreceptor) unit for each color including an image carrier cleaning blade cleaning transfer residual toner (waste toner) remained on a photosensitive drum (image carrier) after transferring and a collected toner container (waste toner box) collecting the transfer residual toner. In addition, the image forming apparatus includes an intermediate transferring body cleaning blade cleaning transfer residual toner remained on an intermediate transferring belt to form a blade rolling-up prevention pattern on a non-image area of the photosensitive drum by a developing roller and to provide the blade rolling-up prevention pattern to the intermediate transferring body cleaning blade. Subsequently, the image forming apparatus includes a filling rate detecting means detecting a rate of the transfer residual toner collected in the collected toner container to a capacity of the collected toner container and to select a color, of which the filling rate of the collected toner container detected by the filling rate detecting means is smallest, as a color used for the blade rolling-up prevention pattern.

The above-mentioned blade turning-up of the cleaning blade is easily caused at an end in a rotation axis direction of the image carrier (a width direction of the recording medium). Incidentally, in the image forming apparatus, in a case where the recording medium has a width corresponding a maximum sheet passing area in the rotation axis direction of the image carrier (e.g. A4 size), the toner image is formed to the vicinity of the end in the rotation axis direction of the image carrier. However, in a case where the recording medium has a correctively narrow width (e.g. a small size, such as A5 size), such as a width equal to or less than a half of the maximum sheet passing area, the toner image is not formed at the vicinity of the end in the rotation axis direction of the image carrier. Therefore, if a proportion of image forming for recording media of the small size becomes high, an amount of the waste toner at the vicinity of the end in the rotation axis direction of the image carrier is decreased and the blade turning-up is easily caused.

Incidentally, if a constant toner is always fed to a non-image forming area of the image carrier, toner consumption is increased regardless of a size of the recording medium. At this time, there are problems that usage efficiency is lowered and that the waste toner box is filled for a short period. If the waste toner box is enclosed with a toner container, the waste toner box is preferably replaced when the toner container is replaced. However, if toner consumption is increased due to restraining of the blade turning-up, the waste toner box may be filled before the toner container is utilized to the fullest. At this time, because it is necessary to prepare and replace a new waste toner box, a cost load and a work load are caused for a user and an unusable state of the image forming apparatus is caused due to replacement of the waste toner box.

SUMMARY

In accordance with an embodiment of the present disclosure, an image forming apparatus includes an image carrier carrying a toner image, a developing device, and a cleaning blade. The developing device carries out developing process feeding toner to the image carrier during image forming. The cleaning blade comes into contact with the image carrier and removes waste toner remained on the image carrier. In order to restrain turning-up of the cleaning blade, turning-up restraining process is carried out to feed the toner from the developing device to the image carrier during non-image forming, every time a given cumulative printing number of image forming operation is finished. In the turning-up restraining process, larger toner is fed to the image carrier as a given small size printing number in the cumulative printing number becomes larger.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 3 is a graph plotting one example of the multiplying factor used for calculating the toner feeding amount, in a case where a variable is not recalculated, in the printer according to the embodiment of the present disclosure.

FIG. 4 is a graph plotting one example of a total collection rate of waste toner, in the case where the variable is not recalculated, in the printer according to the embodiment of the present disclosure.

FIG. 5 is a graph plotting one example of the multiplying factor used for calculating the toner feeding amount, in a case where the variable is recalculated, in the printer according to the embodiment of the present disclosure.

FIG. 6 is a graph plotting one example of the total collection rate of waste toner, in the case where the variable is recalculated, in the printer according to the embodiment of the present disclosure.

DETAILED DESCRIPTION

Figure 1:
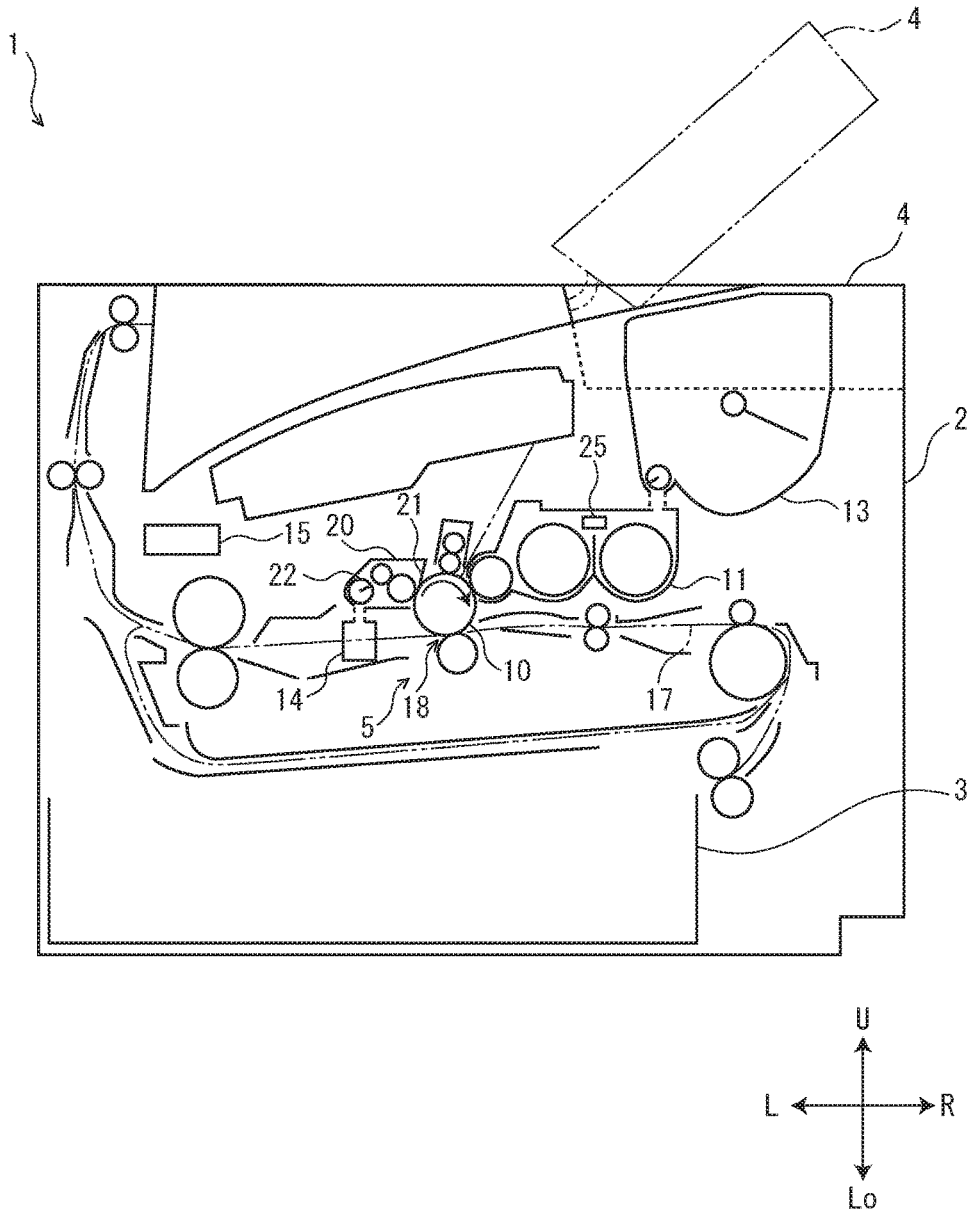
FIG. 1 is a sectional view schematically showing a printer according to an embodiment of the present disclosure.

First, the entire structure of a printer 1 (an image forming apparatus) according to an embodiment of the present disclosure will be described with reference to FIG. 1. For convenience sake, it will be described so that the front side of the printer 1 is positioned at a near side on a paper sheet of FIG. 1. Arrows L, R, U and Lo in each of the drawings respectively indicate a left side, a right side, an upper side and a lower side of the printer 1.

The printer 1 includes a box-like formed printer body 2. In a lower part of the printer body 2, a plurality of sheet feeding cartridges 3 storing sheets are installed. In an upper face of the printer body 2, an ejected sheet tray is formed. The plurality of sheet feeding cartridges 3 store sheets of a plurality of sizes, such as first sheets having a width corresponding a maximum sheet passing area in a rotation axis direction of a photosensitive drum 10 described below (forward and backward directions) (e.g. A4 size) and second sheets having a correctively narrow width (e.g. a small size, such as A5 size), such as a width equal to or less than a half of the maximum sheet passing area. In the upper face of the printer body 2, in order to attach and detach a toner container 13 described below with respect to the printer body 2, an upper cover 4 is openably/closably attached at a side of the ejected sheet tray.

Inside the printer body 2, an exposing device composed of a laser scanning unit (LSU) is located below the ejected sheet tray. Below the exposing device, an image forming part 5 is arranged. In the image forming part 5, the photosensitive drum 10 as an image carrier is rotatably arranged. The photosensitive drum 10 is composed of, for example, amorphous silicon photosensitive body (photoreceptor). Around the photosensitive drum 10, a charging device, a developing device 11, a transferring roller and a cleaning device 12 are located along a rotating direction of the photosensitive drum 10.

To the developing device 11, the toner container 13 containing toner replenished to the developing device 11 is attachably/detachably (replaceably) connected. To the cleaning device 12, a waste toner box 14 collecting waste toner removed from the photosensitive drum 10 by the cleaning device 12 is attachably/detachably (replaceably) connected.

Moreover, inside the printer body 2, a controlling device 15 controlling operations, such as image forming of the printer 1 and turning-up restraining process of a cleaning blade 21 of the cleaning device 12, is provided. The controlling device 15 is composed of, for example, a controlling part, such as CPU, and a storing part, such as ROM and RAM.

Further, inside the printer body 2, a conveying path 17 for the sheet is arranged. At an upstream end of the conveying path 17, a sheet feeding part is positioned near each of the sheet feeding cartridges 3. At an intermediate stream part of the conveying path 17, a transferring part 18 composed of the photosensitive drum and the transferring roller is positioned. At a downstream part of the conveying path 17, a fixing device is positioned. At a downstream end of the conveying path 17, a sheet ejecting part is positioned near the ejected sheet tray.

Next, image forming operation of the printer 1 including such configuration will be described. In the printer 1, when image data is inputted and a printing start is directed from an external computer or the like connected with the printer 1, image forming operation is started. First, in the image forming part 5, the surface of the photosensitive drum 10 is electrically charged by the charging device, and then, is exposed on the basis of the image data by a laser light from the exposing device, thereby forming an electrostatic latent image on the surface of the photosensitive drum 10. Subsequently, the electrostatic latent image is developed to a toner image by the developing device 11 using toner in the image forming part 5.

On the other hand, the sheet stored in the sheet feeding cartridge 3 is picked up by the sheet feeding part and conveyed on the conveying path 17. The sheet on the conveying path 17 is conveyed to the transferring part 18 in a given timing and, in the transferring part 18, the toner image on the photosensitive drum 10 is transferred onto the sheet. The sheet with the transferred toner image is conveyed to the fixing device and, in the fixing device, the toner image is fixed on the sheet. The sheet with the fixed toner image is ejected from the sheet ejecting part to the sheet ejected tray. Incidentally, the toner (waste toner) remained on the photosensitive drum 10 is removed by the cleaning device 12.

Next, the developing device 11 will be described. the developing device 11 is controlled by the controlling device 15 to carry out developing process feeding the toner to the photosensitive drum 10 during image forming and during turning-up restraining process of the cleaning blade 21 of the cleaning device 12.

The developing device 11 includes, for example, a developing roller feeding the toner to the photosensitive drum 10, and an agitating member and a conveying member agitating and conveying the toner, in a housing. The housing has a replenishing port receiving toner replenishing from the toner container 13 and is connected to the toner container 13 via the replenishing port. In addition, the developing device 11 includes a toner amount detecting part 25 detecting a toner amount in the housing and the toner amount detecting part 25 is composed of, for example, a toner density sensor detecting toner density. The developing device 11 receives toner replenishing from the toner container 13 when the toner amount becomes less than a predetermined value.

Next, the cleaning device 12 will be described. The cleaning device 12 removes, from the photosensitive drum 10, the waste toner remained on the photosensitive drum 10 after transferring. The cleaning device 12 includes, for example, a case 20, the cleaning blade 21 and a collecting member 22.

The case 20 is formed in a box-like shape elongated in the rotation axis direction of the photosensitive drum 10 to temporarily store the waste toner removed from the photosensitive drum 10. The case 20 has an opening at a right side and the cleaning device 12 is arranged so that the opening of the case 20 faces to a left side of the surface of the photosensitive drum 10. In addition, the case 20 has an ejecting port ejecting the waste toner to the waste toner box 14 and is connected to the waste toner box 14 via the ejecting port. Incidentally, the case 20 may be connected to the waste toner box 14 via a conveying device conveying the waste toner to the waste toner box 14.

The cleaning blade 21 is made of elastic material, such as urethane rubber, and is formed in a plate-like shape elongated in the rotation axis direction of the photosensitive drum 10. The cleaning blade 21 is attached to the case 20 so that its distal end is positioned at a side of the opening of the case 20 to come into contact with the surface of the photosensitive drum 10 in a counter direction to the rotating direction of the photosensitive drum 10.

The collecting member 22 is formed, for example, as a spiral member elongated in the rotation axis direction of the photosensitive drum 10 and is rotatably arranged in the vicinity of the ejecting port inside the case 20. The collecting member 22 is connected to a driving part (not shown), such as a motor. When the controlling device 15 activates the driving part, the collecting member 22 is rotated by receiving driving force from the driving part. When the collecting member 22 is rotated, the waste toner in the case 20 is conveyed to the waste toner box 14 via the ejecting port.

Next, turning-up restraining process of the cleaning blade 21 of the cleaning device 12 will be described. The turning-up restraining process is controlled, as described above, by the controlling device 15 to feed toner from the developing device 11 to the photosensitive drum 10 when a predetermined process condition is satisfied and during non-image forming. As the process condition, for example, passing of the predetermined number or a predetermined time of image forming operation (printing operation of the sheet) is set.

Concretely, as the process condition, the cumulative number of printed sheets, i.e., the cumulative printing number PA1 (e.g. 100) is set. Then, the controlling device 15 counts the number of image forming operation, i.e., the number of printed sheets or the printing number, from start to end (replacement) of use of the toner container 13 and decides whether or not the printing number reaches the cumulative printing number PA1. If the printing number reaches the cumulative printing number PA1, the controlling device 15 controls components of the printer 1 so as to carry out the turning-up restraining process at a timing of non-image forming and to reset the printing number to zero. In other words, assuming that the cumulative printing number PA1 of image forming operation is one section, the controlling device 15 carries out one turning-up restraining process every time each section is finished. Incidentally, the controlling device 15 may count the total number of printed sheets, i.e., the total printing number, from start to end of use of the toner container 13.

In each turning-up restraining process, in order to calculate a toner feeding amount from the developing device 11 to the photosensitive drum 10 and others, information used in the corresponding section is utilized. For example, the information has sizes of respective sheets used in the cumulative printing number PA1 of image forming operation in the corresponding section and an average printing rate RIA of the cumulative printing number PA1 of image forming operation in the corresponding section. Therefore, in each image forming operation, a size of the sheet and a printing rate are recorded. In the turning-up restraining process, the average printing rate RIA is calculated by respective printing rates of the cumulative printing number PA1 of image forming operation. Incidentally, the printing rate is converted into a size of the first sheet regardless a size of a printed sheet. For example, when the printing rate of printing operation with respect to the second sheet is 2%, the printing rate is converted into 1% for the first sheet.

The controlling device 15 calculates a ratio (PA2/PA1) of the number of printed sheets in a case of the second sheet, i.e., the small size printing number PA2, with respect to the cumulative printing number PA1 in the corresponding section. The controlling device 15 calculates, on the basis of the ratio and a variable k, a multiplying factor PDR used for calculating the toner feeding amount of the turning-up restraining process. The multiplying factor PDR is calculated, for example, by a mathematical expression of k*(PA2/PA1)+1. The toner feeding amount is calculated by multiplying a multiplication value of a given base amount Ba per sheet (e.g. 0.0002 (the printing rate of 0.02% for the first sheet)) and the cumulative printing number PA1 by the multiplying factor PDR. As the small size printing number PA2 becomes larger, the multiplying factor PDR becomes larger and the toner feeding amount becomes larger.

The variable k used for calculating the multiplying factor PDR is varied in a case where the average printing rate RIA in the cumulative printing number PA1 is low and the ratio of the small size printing number PA2 is high, for example, varied within a range of to 9. An initial value (a maximum value) of the variable k is set to 9. If the variable k is not appropriate, the variable k is recalculated. When the variable k is 9, for example, in a case where the small size printing number PA2 is 0 (all of the cumulative printing number PA1 of image forming operation is carried out to the first sheet), the multiplying factor PDR becomes 1. On the other hand, in a case where the small size printing number PA2 is equal to the cumulative printing number PA1 (all of the cumulative printing number PA1 of image forming operation is carried out to the second sheet), the multiplying factor PDR becomes 10. As the variable k becomes larger, the multiplying factor PDR becomes larger and the toner feeding amount becomes larger. On the other hand, as the variable k becomes smaller, the multiplying factor PDR becomes smaller and the toner feeding amount becomes smaller.

Appropriateness decision and recalculation of the variable k in a specified turning-up restraining process will be described. Here, assuming that image forming operation (developing process of the developing device 11) and the turning-up restraining process are repeated by using the ratio (PA2/PA1) of the small size printing number PA2 and the average printing rate RIA in the cumulative printing number PA1 of image forming operation corresponding to the specified turning-up restraining process, and then, a whole toner amount Ta in the toner container 13 is consumed. At this time, if a total collecting amount C2 collected in the waste toner box 14 exceeds a capacity (e.g. 120 g) of the waste toner box 14, the variable k is recalculated smaller than the initial value.

Concretely, the controlling device 15 calculates a first consumption amount Y1 of the toner consumed per sheet by developing process of the developing device 11 with respect to the cumulative printing number PA1 of image forming operation corresponding to the specified turning-up restraining process. The first consumption amount Y1 [mg] is calculated, for example, by a mathematical expression of a1*(RIA/a2). A first coefficient a1 is a toner consumption amount based on JIS X 6931 standards (e.g. 26.2 [mg]) and a second coefficient as is a printing rate based on JIS X 6931 standards (e.g. 0.038 (3.8%)). Incidentally, the average printing rate RIA is determined by converting printing rates of the cumulative printing number PA1 of sheets into the first sheet and averaging converted printing rates.

Moreover, the controlling device 15 calculates a second consumption amount Y2 of the toner consumed per sheet by the turning-up restraining process in a case where the variable k is set to the initial value. The second consumption amount Y2 [mg] is calculated, for example, by a mathematical expression of a1*(Ba/a2)*PDR. Subsequently, the controlling device 15 calculates a total consumption amount Y3 of the toner consumed per sheet in the developing device 11 by adding the first consumption amount Y1 and the second consumption amount Y2.

Further, the controlling device 15 calculates the total number of sheets printable by the whole toner amount Ta (e.g. 669.7 [g]) in a case where the developing process of the developing device 11 and the turning-up restraining process are repeated by using the total consumption amount Y3 per sheet, i.e., the total printing number PA3. The total printing number PA3 is calculated, for example, by a mathematical expression of (Ta*1000)/Y3.

Furthermore, the controlling device 15 calculates a collecting amount C1 of the waste toner removed from the photosensitive drum 10 by the cleaning device 12 and collected in the waste toner box 14 in a case where the toner of the total consumption amount Y3 per sheet is consumed by the developing device 11, i.e., the collecting amount C1 per sheet. The collecting amount C1 [mg] is calculated, for example, by a mathematical expression of (Y1*a3)+Y2. A third coefficient a3 is a residual rate (e.g. 0.07 (7%)) of the toner remained after transferring of the transferring part 18 about the toner image on the photosensitive drum 10 in developing process. Incidentally, about the second consumption amount Y2 of the turning-up restraining process, since transferring is not carried out, the third coefficient a3 is not applied.

Then, the controlling device 15 calculates the total collecting amount C2 of the waste toner collected in the waste toner box 14 until the whole toner amount Ta of the toner container 13 is consumed. The total collecting amount C2 [g] is calculated, for example, by a mathematical expression of C1*PA3. By substituting the above-described expressions for this mathematical expression, the mathematical expression calculating the total collecting amount C2 [g] becomes ((350*RIA+PDR)/(5000*RIA+PDR))*Ta.

Next, the controlling device 15 establishes the variable k without recalculating in a case the total collecting amount C2 as calculated above is equal to or less than the capacity of the waste toner box 14 or a safety amount resulted by subtracting a safety factor (e.g. 10%) from the capacity.

On the other hand, the controlling device 15 recalculates the variable k by subtracting a predetermined value (e.g. 1) from the variable k in a case the total collecting amount C2 exceeds the capacity or the safety amount of the waste toner box 14. The above-described appropriateness decision and recalculation of the variable k is carried out until the variable k is established.

If the variable k is established, the controlling device 15 calculates the toner feeding amount by using the variable k and carries out the turning-up restraining process by the calculated toner feeding amount at a timing of non-image forming.

Figure 2:
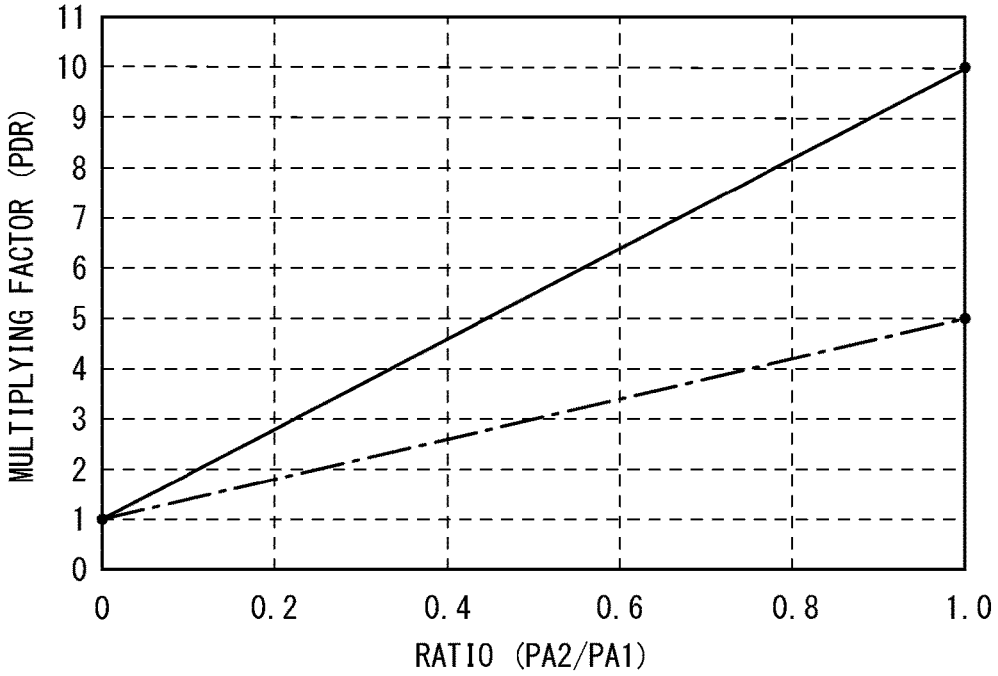
FIG. 2 is a graph plotting a rate of the small size printing number to the cumulative printing number and a multiplying factor used for calculating a toner feeding amount in turning-up restraining process of a cleaning blade in the printer according to the embodiment of the present disclosure.

A concrete example of the variable k and the multiplying factor PDR as calculated above will be described with reference to FIG. 2. As an example, in a case where the multiplying factor PDR used for calculating the toner feeding amount is calculated by a mathematical expression of k*(PA2/PA1)+1, as shown in FIG. 2, with respect to the multiplying factor PDR when the variable k is initial value of 9 (refer to a solid line in FIG. 2), the multiplying factor PDR when the variable k is decreased to 4 (refer to a dot chain line in FIG. 2) is lowered.

Incidentally, in a case where recalculation of the variable k as described above is not carried out (the variable k is maintained in the initial value of 9), as shown in FIG. 3, the multiplying factor PDR is varied in accordance with the ratio (PA2/PA1) of the small size printing number PA2 of the second sheet, but not varied regardless varying of the average printing rate RIA. As shown in FIG. 4, as the ratio (PA2/PA1) of the small size printing number PA2 of the second sheet becomes larger and the average printing rate RIA becomes larger, the total collecting amount C2 becomes larger. However, in the case where recalculation of the variable k is not carried out, the total collecting amount C2 may exceed the capacity or the safety amount of the waste toner box 14 (refer to an underline in FIG. 4).

Thereupon, if the recalculation of the variable k as described above is carried out, as shown in FIG. 5, the variable k is set so that the multiplying factor PDR becomes smaller as the ratio (PA2/PA1) of the small size printing number PA2 of the second sheet becomes larger and the average printing rate RIA becomes larger (refer to an underline in FIG. 5). Thereby, as shown in FIG. 6, the total collecting amount C2 always becomes equal to or less than the capacity or the safety amount of the waste toner box 14.

In accordance with the embodiment, as described above, the printer 1 (the image forming apparatus) includes the photosensitive drum 10 (image carrier) carrying the toner image, the developing device 11 carrying out developing process feeding the toner to the photosensitive drum 10 during image forming, and the cleaning blade 21 coming into contact with the photosensitive drum 10 and removing the waste toner remained on the photosensitive drum 10. The printer 1 carries out, in order to restrain turning-up of the cleaning blade 21, turning-up restraining process feeding the toner from the developing device 11 to the photosensitive drum 10 during non-image forming, every time the given cumulative printing number PA1 of image forming operation is finished. In the turning-up restraining process, the printer 1 feeds larger toner to the photosensitive drum 10 as the given small size printing number PA2 in the cumulative printing number PA1 becomes larger.

According to such configuration, if the small size printing number PA2 of the second sheet is large and the toner amount fed to the photosensitive drum 10 by developing process is small, it is possible to apply relatively large toner feeding amount into the turning-up restraining process of the cleaning blade 21. Therefore, an eternal additive of the toner is not exhausted on the photosensitive drum 10 and frictional force between the cleaning blade 21 and the surface of the photosensitive drum 10 can be excellently maintained. Thereby, it is possible to restrain a phenomenon that the cleaning blade 21 is turned up by rotation of the photosensitive drum 10 and to appropriately remove the waste toner from the photosensitive drum 10. Therefore, it is possible to excellently form the image by using the photosensitive drum 10. Incidentally, in a case where the ratio of the small size printing number PA2 of the second sheet is small, it is possible to apply relatively small toner feeding amount into the turning-up restraining process of the cleaning blade 21. Therefore, it is possible to restrain excessive consumption of the toner and increase of the waste toner and to use the toner container 13 and the waste toner box 14 for a long period. Thus, it is possible to appropriately restrain turning-up of the cleaning blade 21 by using the toner of an appropriate amount.

For example, in the turning-up restraining process, the printer 1 may calculate the multiplying factor PDR on the basis of the ratio (PA2/PA1) of the small size printing number PA2 to the cumulative printing number PA1 and the variable k, in which the variable k is varied in a case where the average printing rate RIA of the cumulative printing number PA1 of image forming operation is low and the ratio of the small size printing number PA2 is high, and calculate the toner feeding amount to the photosensitive drum 10 by multiplying the base amount Ba by the multiplying factor PDR.

Moreover, for example, the printer 1 further includes the toner container 13 containing the toner replenished to the developing device 11, and the waste toner box 14 collecting the waste toner removed by the cleaning blade 21. In the turning-up restraining process, the printer 1 calculates, on the basis of the average printing rate RIA, the first consumption amount Y1 of the toner consumed per sheet with respect to the cumulative printing number PA1 of developing process. The printer 1 calculates, on the basis of the multiplying factor PDR in a case where the variable is set to the maximum value, the second consumption amount Y2 of the toner consumed per sheet with respect to the turning-up restraining process. The printer 1 calculates the total consumption amount Y3 of the toner consumed per sheet by adding the first consumption amount Y1 and the second consumption amount Y2. Further, the printer 1 calculates the total printing number PA3 of sheets printable by the whole toner amount Ta of the toner container 13 in a case where the developing process and the turning-up restraining process are repeated by using the total consumption amount Y3. The printer 1 calculates, on the basis of the total consumption amount Y3, the collecting amount C1 of the waste toner collected in the waste toner box 14 per sheet. The printer 1 calculates, on the basis of the collecting amount C1 and the total printing number PA3, the total collecting amount C2 of the waste toner collected in the waste toner box 14 with respect to the whole toner amount Ta of the toner container 13. Subsequently, in a case where the total collecting amount C2 exceeds the capacity or the safety amount of the waste toner box 14, the printer 1 recalculates the variable k by subtracting the predetermined value and recalculates the toner feeding amount by the recalculated variable k.

According to such configuration, it is possible to more appropriately calculate the toner feeding amount necessary to turning-up restraining process of the cleaning blade 21 and to more appropriately restrain turning-up of the cleaning blade 21. Incidentally, the toner container 13 ant the waste toner box 14 are preferably installed at the same time, and replaced at the same time. According to the above-described configuration, the waste toner box 14 is not filled before the toner container 13 is utilized to the fullest, and then, replacement of only the waste toner box 14 is not required. Therefore, it is possible to reduce a load of a user replacing the toner container 13 and the waste toner box 14.

Moreover, in the embodiment, the photosensitive drum 10 may be composed of an amorphous silicon photosensitive body (photoreceptor). In a case where the amorphous silicon photosensitive body is applied into the photosensitive drum 10, increasing of frictional force to the cleaning blade 21 is feared. However, in the embodiment, as described above, since the appropriate toner feeding amount for turning-up restraining process of the cleaning blade 21 is used, it is possible to restrain frictional force between the photosensitive drum 10 and the cleaning blade 21. Further, since the amorphous silicon photosensitive body is applied into the photosensitive drum 10, it is possible to improve durability of the photosensitive drum 10.

The embodiment was described in a case of applying the configuration of the present disclosure to the monochrome printer 1. On the other hand, in another embodiment, the configuration of the disclosure may be applied to another image forming apparatus, such as a color printer, a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

an image carrier carrying a toner image;

a developing device carrying out developing process feeding toner to the image carrier, in a state that an electrostatic latent image is formed on the image carrier, to develop the electrostatic latent image to the toner image by using the toner during image forming; and a cleaning blade coming into contact with the image carrier and removing waste toner remained on the image carrier, wherein in order to restrain turning-up of the cleaning blade, turning-up restraining process is carried out to feed the toner from the developing device to the image carrier, in a state that any electrostatic latent image is not formed on the image carrier, during non-image forming, every time a given cumulative printing number of image forming operation is finished, in the turning-up restraining process, larger amount of toner is fed to the image carrier as a printing number of small paper size in the cumulative printing number becomes larger, in the turning-up restraining process, on the basis of a ratio of the printing number of small paper size to the cumulative printing number and a variable, in which the variable is varied in a case where an average printing rate in the cumulative printing number of image forming operation is low and the ratio of the small size printing number is high, a multiplying factor is calculated, and a toner feeding amount to the image carrier is calculated by multiplying a given base amount by the multiplying factor.

2. The image forming apparatus according to claim 1 further comprising:

a toner container containing the toner replenished to the developing device; and a waste toner box collecting the waste toner removed by the cleaning blade, wherein in the turning-up restraining process, on the basis of the average printing rate, a first consumption amount of the toner consumed per sheet with respect to the cumulative printing number of developing process is calculated, on the basis of the multiplying factor in a case where the variable is set to a maximum value, a second consumption amount of the toner consumed per sheet with respect to the turning-up restraining process is calculated, a total consumption amount of the toner consumed per sheet is calculated by adding the first consumption amount and the second consumption amount, a total printing number of sheets printable by a whole toner amount of the toner container in a case where the developing process and the turning-up restraining process are repeated by using the total consumption amount is calculated, on the basis of the total consumption amount, a collecting amount of the waste toner collected in the waste toner box per sheet is calculated, on the basis of the collecting amount and the total printing number, a total collecting amount of the waste toner collected in the waste toner box with respect to the whole toner amount of the toner container is calculated, in a case where the total collecting amount exceeds a capacity of the waste toner box or a safety amount of the waste toner box calculated by subtracting a predetermined safety factor from the capacity, the variable is recalculated by subtracting a predetermined value and the toner feeding amount is recalculated by using the recalculated variable.

3. The image forming apparatus according to claim 1, wherein the variable is set within a range of 1 to 9, and then, as the variable becomes larger, the multiplying factor becomes larger and the toner feeding amount becomes larger.

4. The image forming apparatus according to claim 1, wherein in a case the total collecting amount is equal to or less than a capacity or a safety amount of the waste toner box, the variable is established without recalculating.

5. The image forming apparatus according to claim 1, wherein the image carrier is composed of an amorphous silicon photosensitive body.

* * * * *